US006884201B2

(12) United States Patent
Wu

(10) Patent No.: US 6,884,201 B2
(45) Date of Patent: Apr. 26, 2005

(54) LIFTING DEVICE FOR A PLATFORM OF TREADMILLS

(75) Inventor: Shen Yi Wu, Taichung Hsien (TW)

(73) Assignee: Strength Master Health Corp., Taichung Hsien (TW)

( * ) Notice: Subject to any disclaimer, the term of this patent is extended or adjusted under 35 U.S.C. 154(b) by 32 days.

(21) Appl. No.: 10/640,053

(22) Filed: Aug. 14, 2003

(65) Prior Publication Data

US 2005/0037899 A1 Feb. 17, 2005

(51) Int. Cl.[7] ..... A63B 22/02
(52) U.S. Cl. ..... 482/54
(58) Field of Search ..... 482/54

(56) References Cited

U.S. PATENT DOCUMENTS 5,746,682 A * 5/1998 Hung ..... 482/54
6,527,679 B1 * 3/2003 Wang et al. ..... 482/54
6,579,211 B1 * 6/2003 Wu ..... 482/54
6,811,518 B1 * 11/2004 Lin ..... 482/54

* cited by examiner

*Primary Examiner*—Stephen R. Crow
(74) *Attorney, Agent, or Firm*—Rosenberg, Klein & Lee

(57) ABSTRACT

A lifting device for a platform of a treadmill includes a telescope shaft has a front end pivotally connected to a front portion of the platform. A power source is laterally mounted to the telescope shaft for reciprocally telescopically driving the telescope shaft. Two first linkages each has a first end pivotally connected to the two opposite sides of the base member and a second end pivotally connected to the two opposite sides of the platform. Two second linkages each includes a first end having a roller rotatably mounted thereto and a second end pivotally connected to the two opposite sides of the platform. A second connecting rod securely connected to the two second linkages. A pivot seat extends from the second connecting rod and a second end of the telescope shaft is pivotally mounted to the pivot seat.

2 Claims, 9 Drawing Sheets

LIFTING DEVICE FOR A PLATFORM OF TREADMILLS

BACKGROUND OF THE INVENTION

1. Field of the Invention

The present invention relates to a lifting device, and more particularly to a lifting device for a platform of treadmills.

2. Description of Related Art

A conventional lifting device for a platform of a treadmill in accordance with the prior art shown in FIG. 7 is adapted to be mounted between a stand (6) and a platform (7) of the treadmill. The lifting device comprises two first linkages (81), two second linkages (82) each pivotally connected to a corresponding one of the two first linkages (81) and a telescope shaft (83) for adjusting the working angle of the platform (7) and driving the linkages (81, 82). The stand (6) two opposite lower end each having a projecting rod (61) horizontally extending therefrom. Each first linkage (81) has a first end pivotally connected to a rear portion of the projecting rod (61) and a second pivotally connected to a bottom of the platform (7). Each second linkage (82) has a first end pivotally connected to the second end of each of the two first linkages (81) and a second end connected by an axle (821). The axle (821) includes two opposite ends each having a roller (822) rotatably mounted to the axle (821). The two rollers (822) are moved between the two projecting rods (61) of the stand (6). The telescope shaft (83) is partially received in a motor (831) and reciprocally telescopically driven by the motor (831). The motor (831) is pivotally connected to the platform (7) and the free end of the telescope shaft (83) is pivotally connected to the axle (821).

With reference to FIGS. 8 and 9, when folding the treadmill, the free end of the telescope shaft (83) is first backwardly moved relative to the motor (831) to make a front end of the platform (7) selectively pivotally to a seat (62) of the treadmill and then the front end of the platform (7) can not be upwardly moved again. Secondary, the telescope shaft (83) extends to make the rollers (822) move toward the first end of the first linkage (81). Lastly, the free end of the telescope shaft (83) is backward moved to continually lift the platform (7) till the platform (7) is perpendicular relative to the supporting surface.

As described above, the telescope shaft (83) is reciprocally moved relative to the motor (831) that may shorten the using life of the telescope shaft (83) and the motor. Furthermore, the platform (7) cannot be lifted when the free end of the telescope shaft (83) has been moved toward the motor (831) and the platform (7) has a small working angle relative to the supporting surface.

The present invention has arisen to mitigate and/or obviate the disadvantages of the conventional lifting device for a platform of a treadmill.

SUMMARY OF THE INVENTION

The main objective of the present invention is to provide an improved lifting device for a platform of a treadmill. The lifting device of the present invention is provides for user to fold the treadmill without caring the condition of the telescope shaft.

To achieve the objective, the lifting device in accordance with the present invention comprises a telescope shaft has a front end pivotally connected to a front portion of the platform. A power source is laterally mounted to the telescope shaft for reciprocally telescopically driving the telescope shaft. Two first linkages each has a first end pivotally connected to the two opposite sides of the base member and a second end pivotally connected to the two opposite sides of the platform. Two second linkages each includes a first end having a roller rotatably mounted thereto and a second end pivotally connected to the two opposite sides of the platform. A second connecting rod securely connected to the two second linkages. A pivot seat extends from the second connecting rod and a second end of the telescope shaft is pivotally mounted to the pivot seat.

Further benefits and advantages of the present invention will become apparent after a careful reading of the detailed description with appropriate reference to the accompanying drawings.

DETAILED DESCRIPTION OF THE INVENTION

Figure 1:
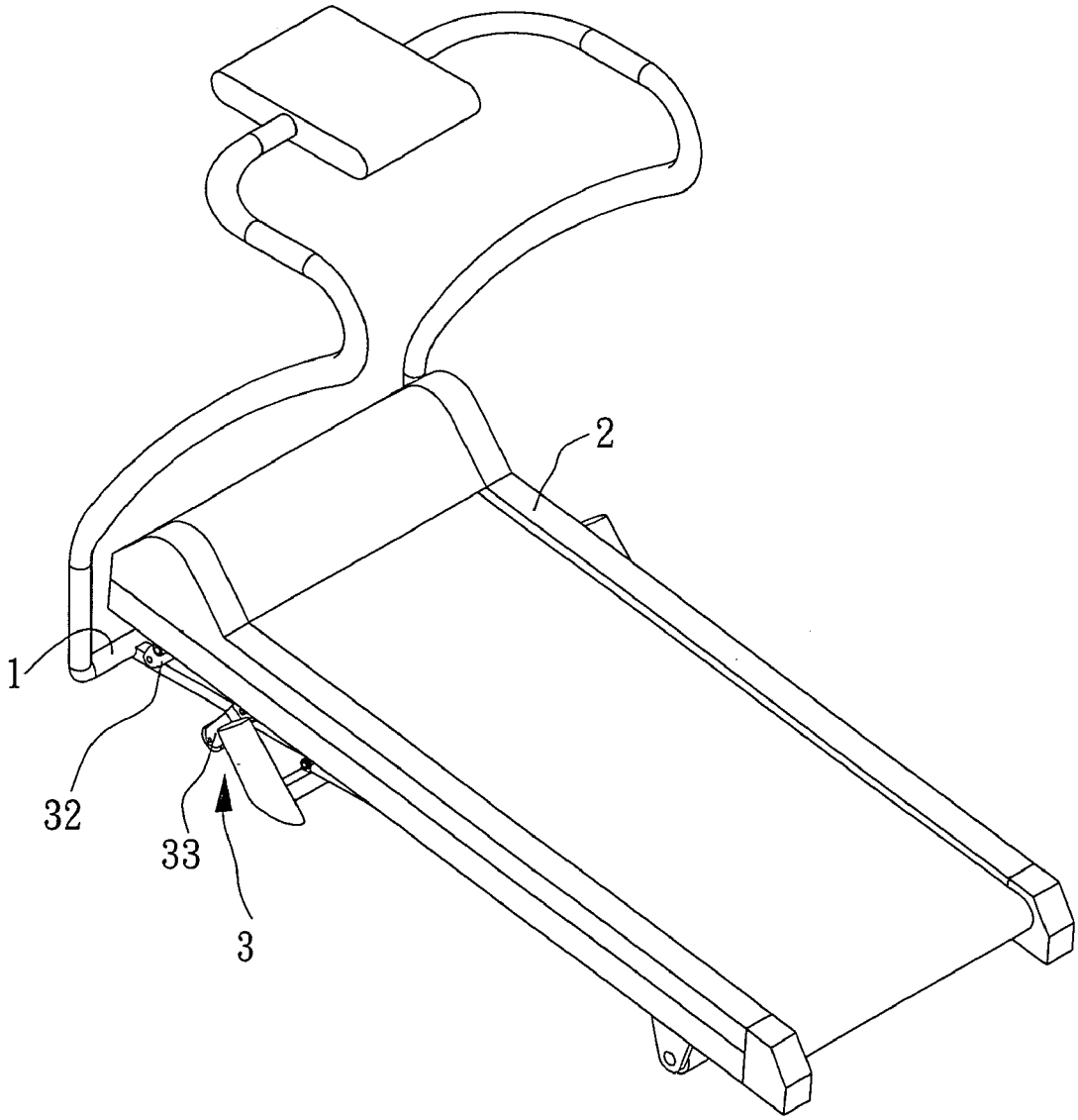
FIG. 1 is a perspective view of a treadmill with a lifting device for a platform of a treadmill in accordance with the present invention.
Figure 2:
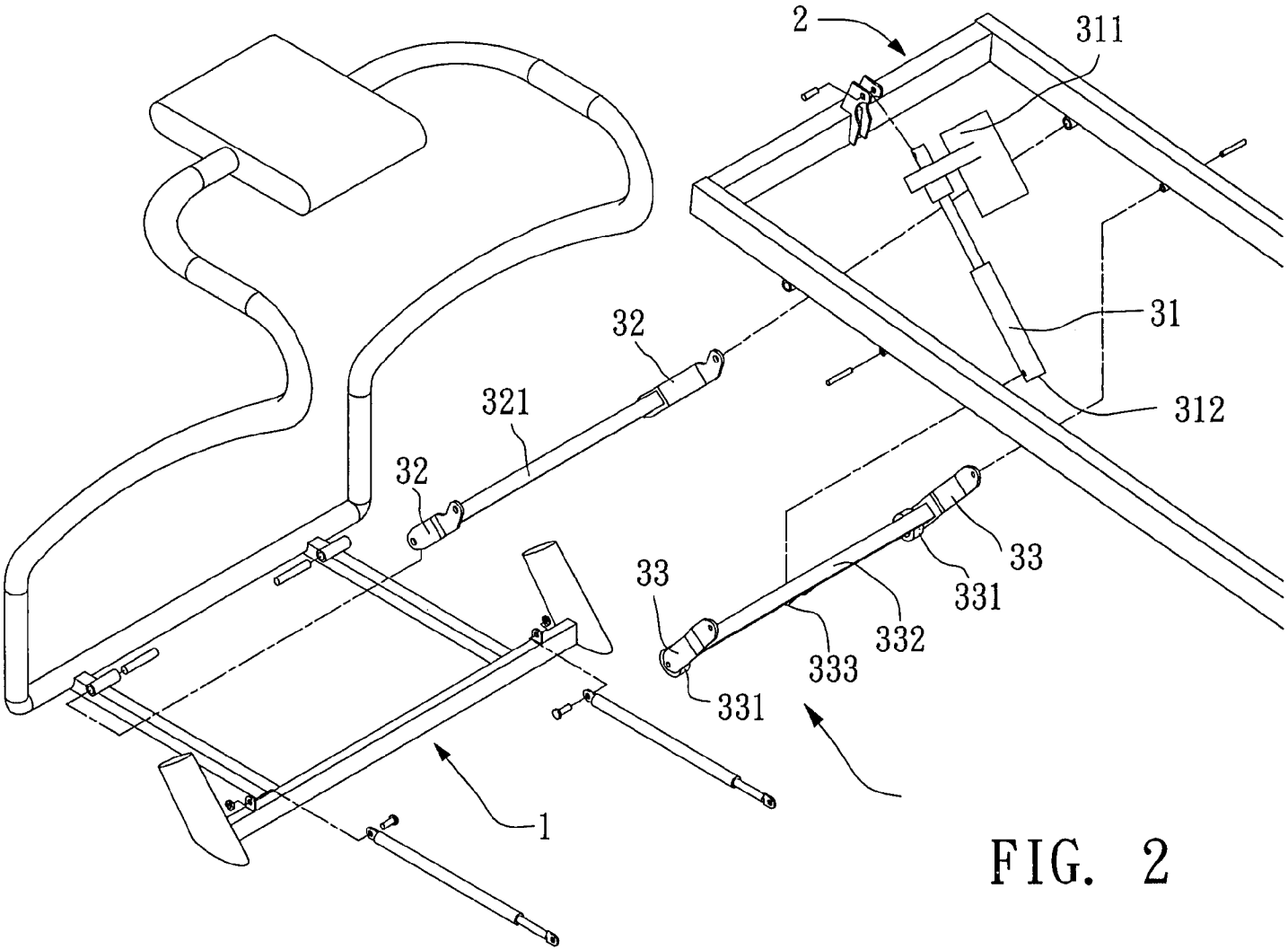
FIG. 2 is an exploded perspective view of the lifting device in FIG. 1.

Referring to the drawings and initially to FIGS. 1 and 2, a lifting device for a platform of a treadmill in accordance with the present invention comprises a telescope shaft (31) has a front end adapted to be pivotally connected to a front portion of the platform (2) and a second end (312) opposite the first end telescope shaft (31). A power source (311) is laterally mounted to the telescope shaft (31) for reciprocally telescopically driving the telescope shaft (31). In the preferred embodiment of the present invention, the power source (311) is a motor.

Two first linkages (32) are adapted to be respectively pivotally connected to two opposite sides of a base member (1) and two opposite sides of the platform (2). Each first linkage (32) has a first end pivotally connected to a corresponding one of the two opposite sides of the base member (1) and a second end pivotally connected to a corresponding one of the two opposite sides of the platform (2). A first connecting rod (321) has two opposite end each securely connected to a corresponding one of the two first linkages (32).

Two second linkages (33) are adapted to be pivotally connected to two opposite sides of the base member (1) and the two opposite sides of the platform (2). The two second linkages (33) are mounted behind the two first linkages (32) relative to the treadmill. Each second linkage (33) includes a first end having a roller (331) rotatably mounted to the first end of each of the two second linkages (33) and a second end pivotally connected to a corresponding one of the two opposite sides of the platform (2). A second connecting rod (332) has two opposite ends each securely connected to a corresponding one of the two second linkages (332). A pivot seat (333) extends from the second connecting rod (332) and the free end (312) of the telescope shaft (31) is pivotally mounted to the pivot seat (333).

Figure 3:
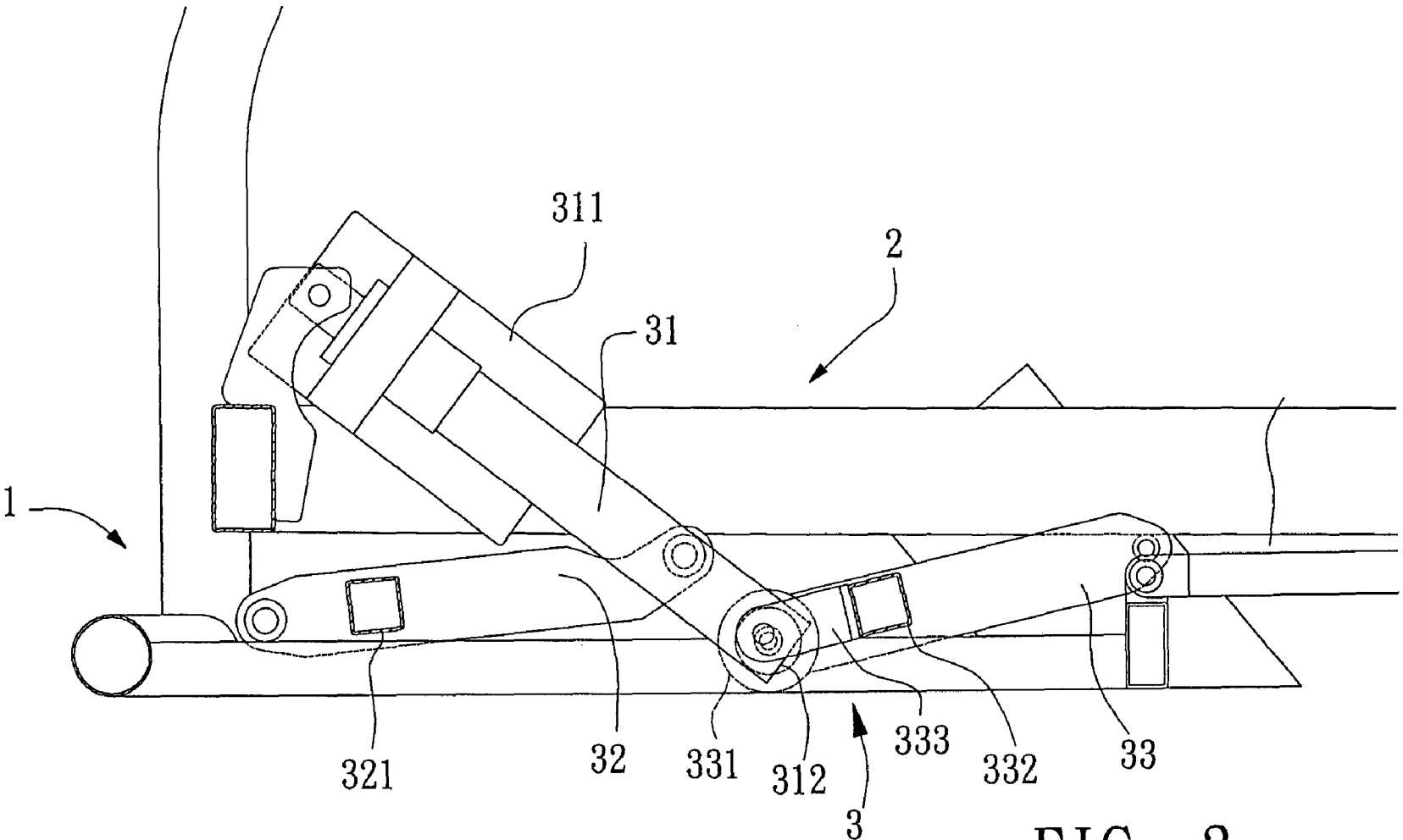
FIG. 3 is a side plan view of the lifting device in FIG. 1.
Figure 4:
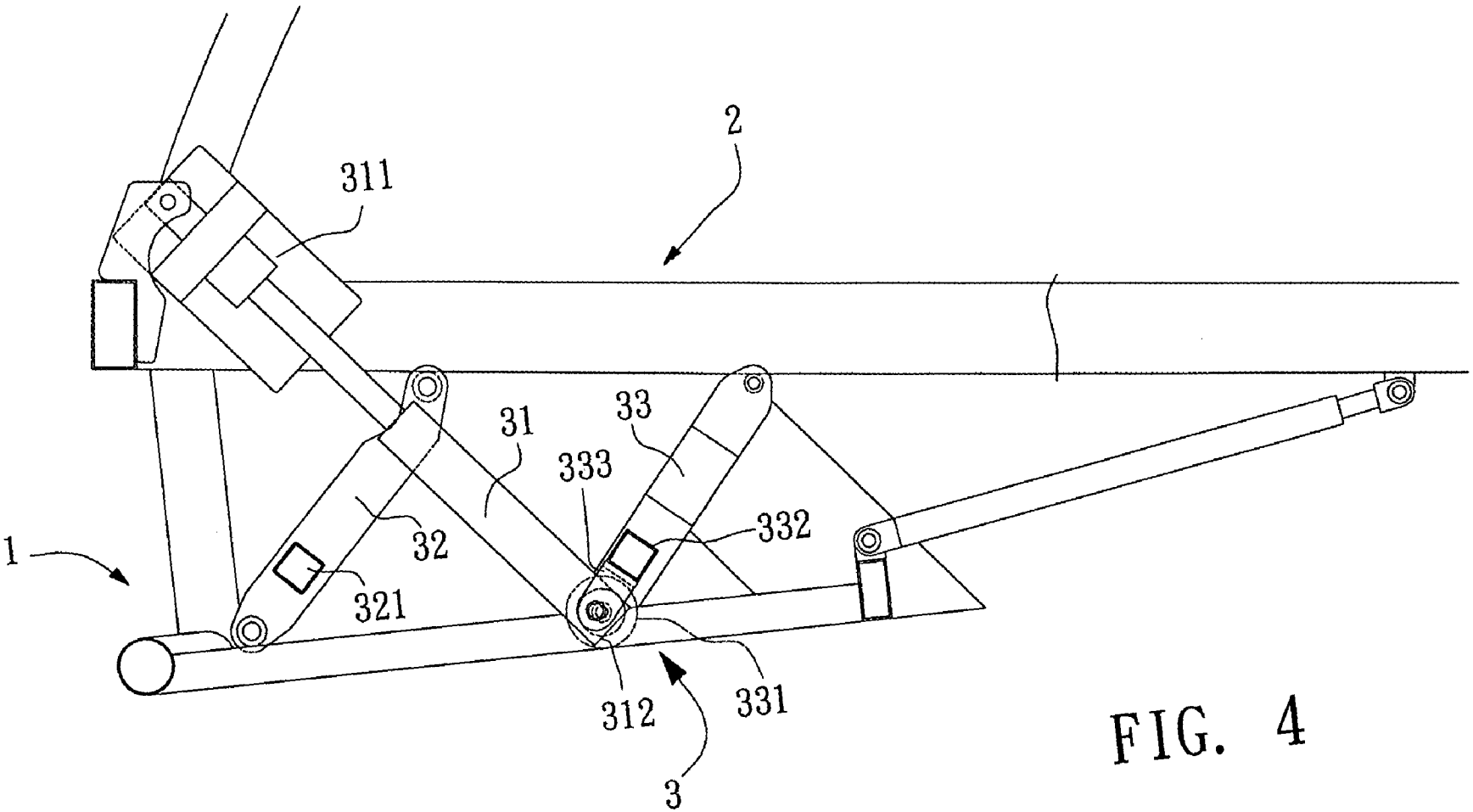
FIG. 4 is an operational side plan view of the lifting device in FIG. 1 when lifting the platform of the treadmill.

With reference to FIGS. 3 and 4, the front portion of the platform (2) is upwards and forwards moved to adjust the operating angle of the platform (2) relative to the supporting surface when the telescope shaft (31) extends to backwards push the second connecting rod (332) because the rollers (331) abut against the supporting surface and the second end of each of the second linkages (33) is pivotally connected to the platform (2). On the contrary, the platform (2) is backwards and downward moved when the free end of the telescope shaft (31) is drawn back to pull the second connecting rod (332) due to the power source (311).

Figure 5:
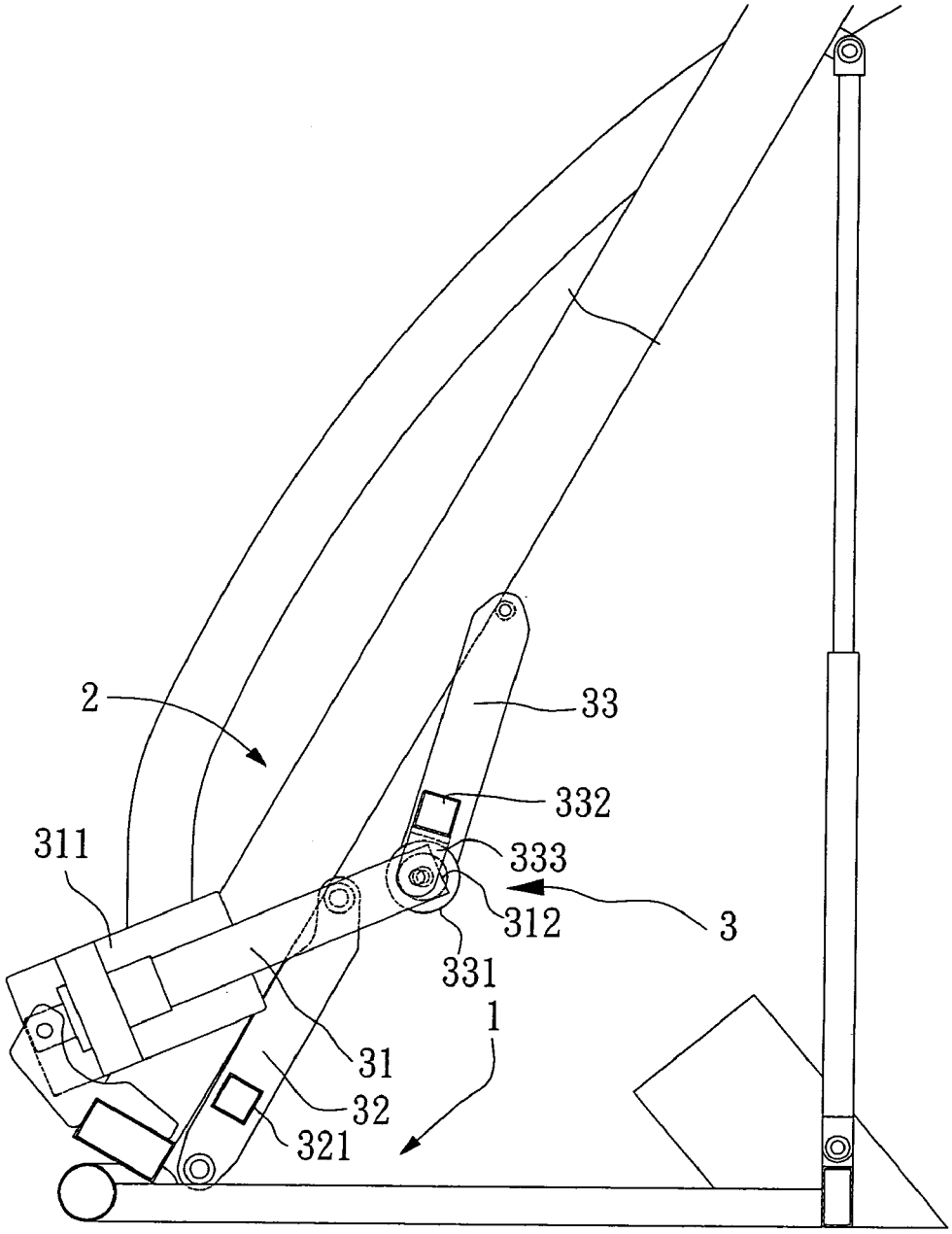
FIG. 5 is a side plan view of the lifting device in FIG. 1 when the treadmill is folded and a telescope shaft of the lifting device has been forwards moved.
Figure 6:
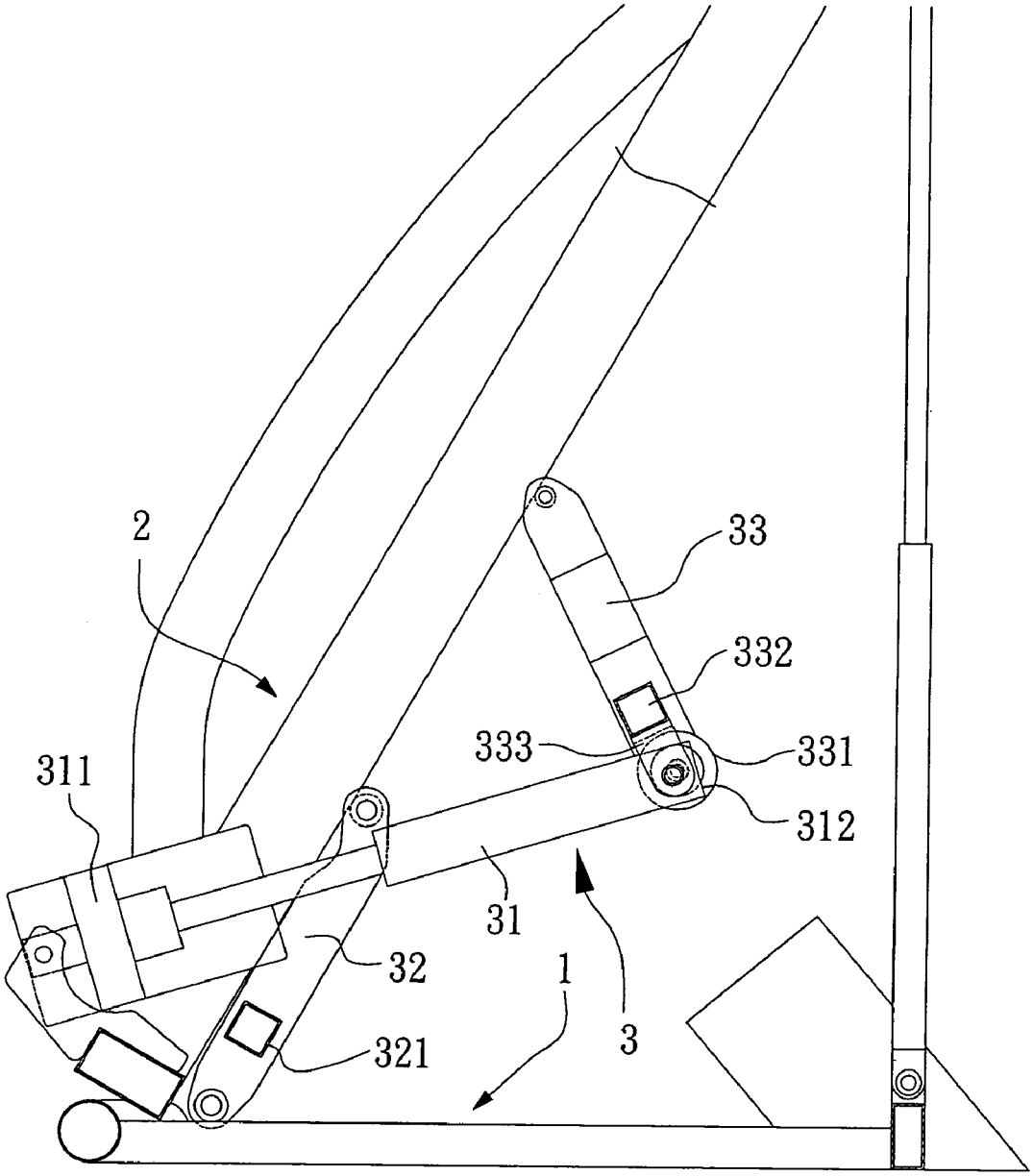
FIG. 6 is a side plan view of the lifting device in FIG. 1 when the treadmill is folded and a telescope shaft of the lifting device has been backward moved.
Figure 7:
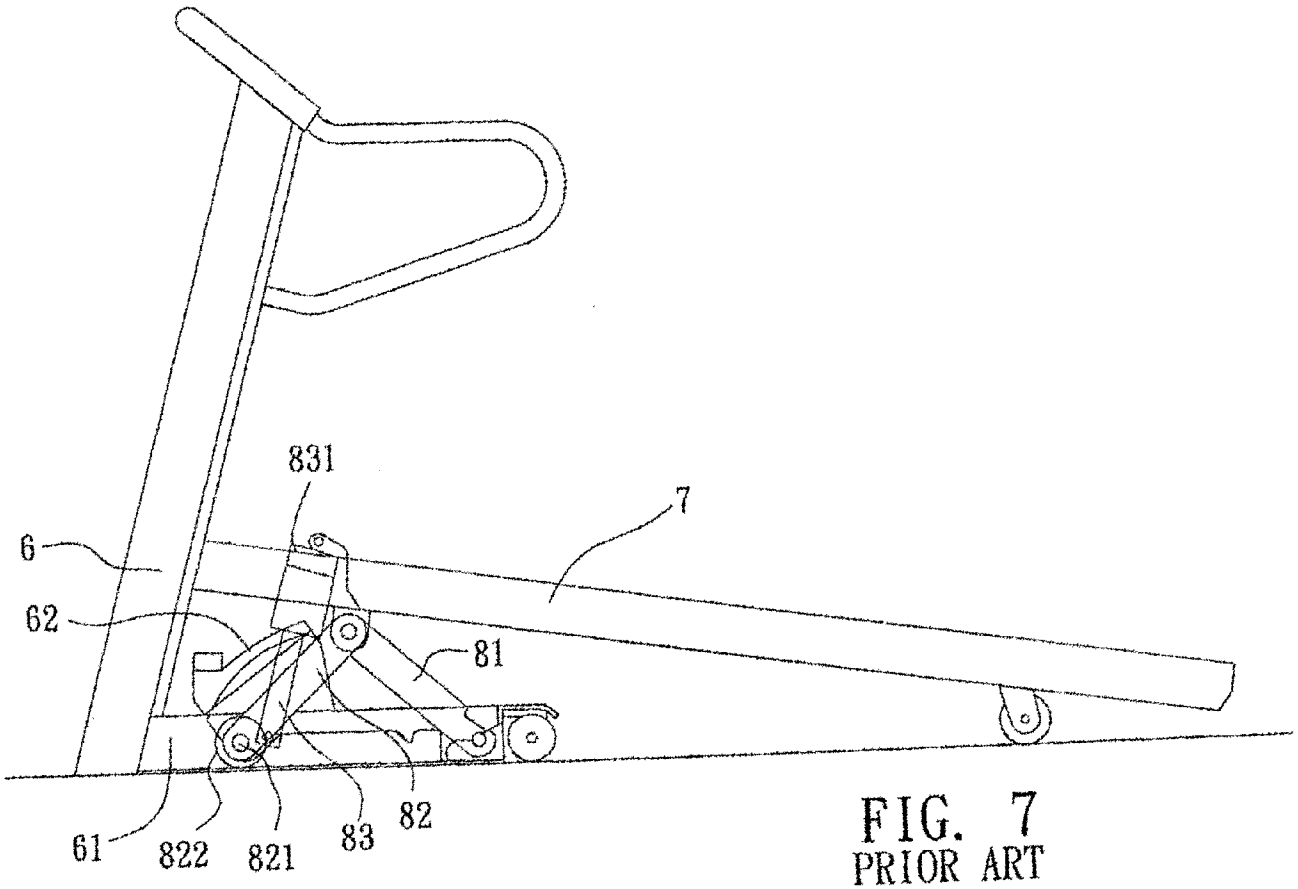
FIG. 7 PRIOR ART
FIG. 7 is a side plan view of a treadmill with a conventional lifting device in accordance with the prior art.
Figure 8:
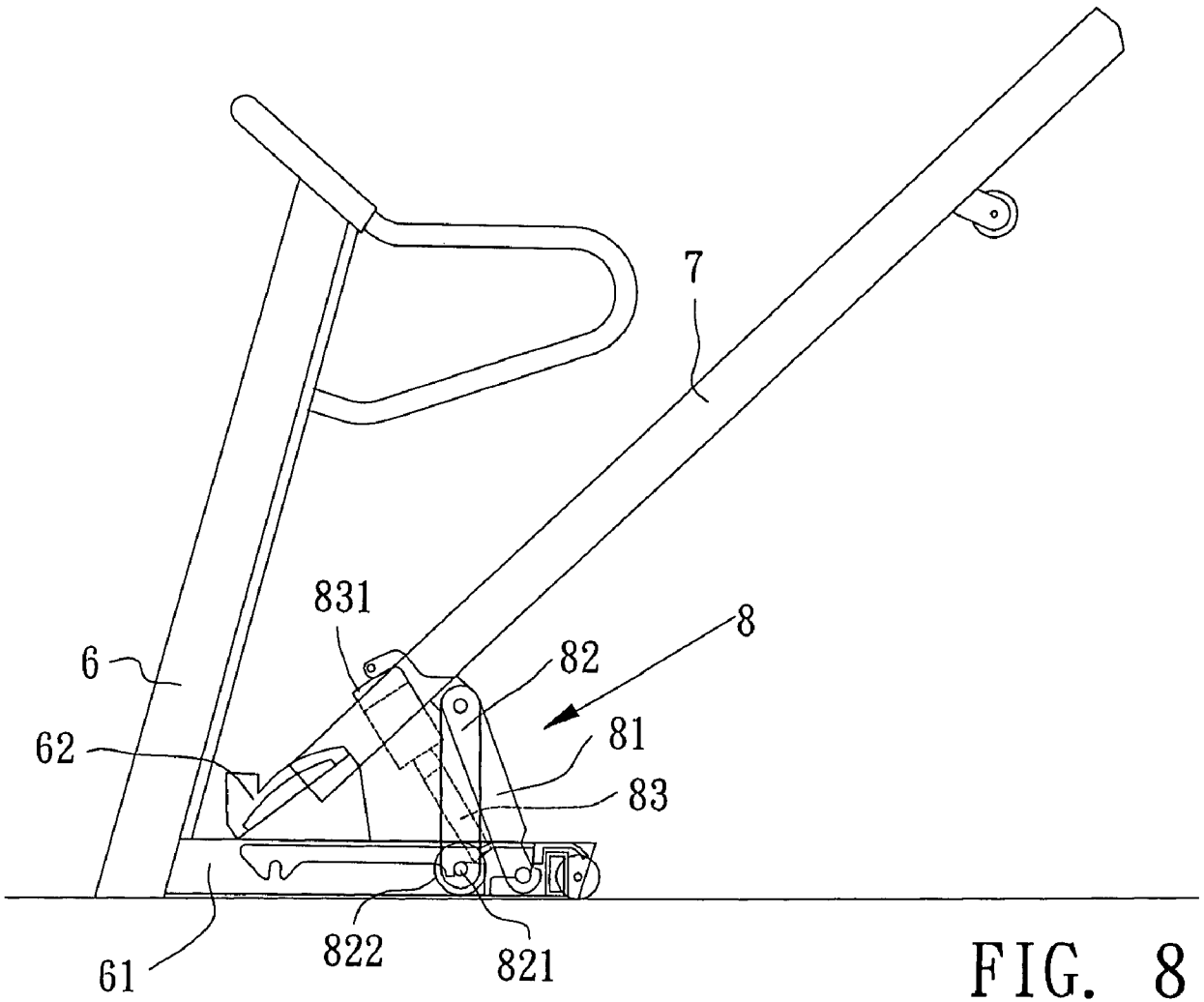
FIG. 8 PRIOR ART
FIG. 8 is an operational side plan of the conventional lifting device when lifting a platform of the treadmill.
Figure 9:
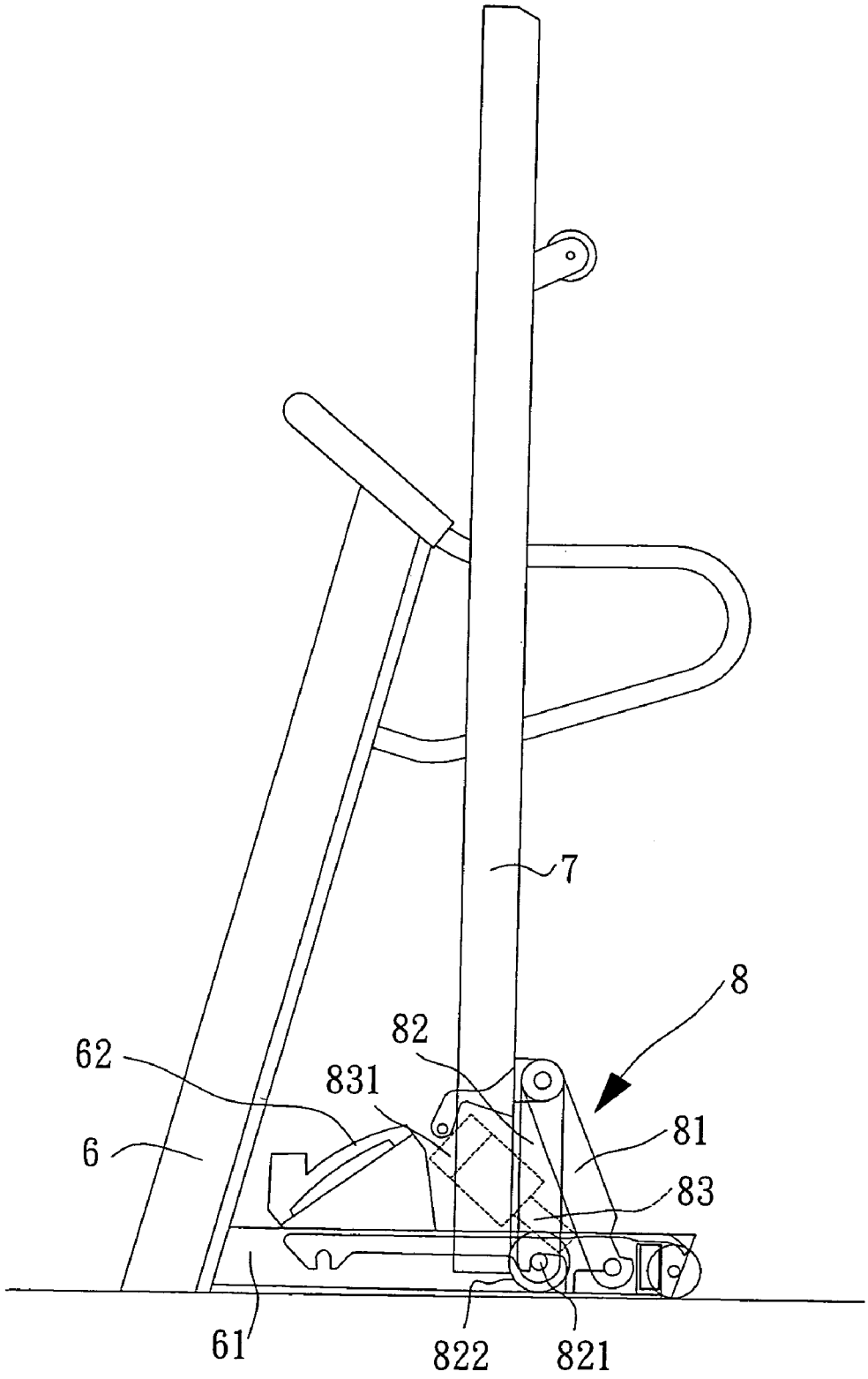
FIG. 9 PRIOR ART
FIG. 9 is a side plan view of the conventional lifting device when the treadmill is folded.

With reference to FIGS. 5 and 6, when folding the treadmill, the pivotal point between the first linkages (32) and the base member (1) is used as fulcrum when the user lifting a rear portion of the platform (2). The telescope shaft (31) and the two second linkages (33) of the lifting device (3) is lifting at the same time when the user lifts the rear portion of the platform (2) to reduce the volume of the treadmill for being easily stored.

The two opposite ends of each of the two first linkages (32) are respectively pivotally connected to the base member (1) and the platform (2) such that rear portion of the platform (2) can be lifted with telescope shaft (31) an the second linkages (33) pivotally relative to the pivot point between the first linkages (32) and the base member (1) whatever the telescope shaft (31) extends or not. It is a convenient design for user to fold the treadmill because the user does not need to care the condition of the telescope shaft (31).

Although the invention has been explained in relation to its preferred embodiment, it is to be understood that many other possible modifications and variations can be made without departing from the spirit and scope of the invention as hereinafter claimed.

What is claimed is:

1. A lifting device for a platform of a treadmill comprising:

a telescope shaft having a front end adapted to be pivotally connected to a front portion of the platform and a second end opposite the first end telescope shaft, a power source laterally mounted to the telescope shaft for reciprocally telescopically driving the telescope shaft;

two first linkages adapted to be respectively pivotally connected to two opposite sides of a base member and two opposite sides of the platform, each first linkage having a first end pivotally connected to a corresponding one of the two opposite sides of the base member and a second end pivotally connected to a corresponding one of the two opposite sides of the platform, a first connecting rod having two opposite end each securely connected to a corresponding one of the two first linkages; and two second linkages adapted to be pivotally connected to the two opposite sides of the base member and the two opposite sides of the platform, the two second linkages mounted behind the two first linkages relative to the treadmill, each second linkage including a first end having a roller rotatably mounted to the first end of each of the two second linkages and a second end pivotally connected to a corresponding one of the two opposite sides of the platform, a second connecting rod having two opposite ends each securely connected to a corresponding one of the two second linkages, a pivot seat extending from the second connecting rod and the second end of the telescope shaft pivotally mounted to the pivot seat;

whereby the pivotal point between the first linkages and the base member is used as fulcrum when the user lifting a rear portion of the platform.

2. The lifting device as claimed in claim 1, wherein the power source is a motor.

* * * * *